US006386012B2

(12) United States Patent
Minamidate et al.

(10) Patent No.: US 6,386,012 B2
(45) Date of Patent: May 14, 2002

(54) METHOD AND DEVICE FOR PRODUCING BELLOWS

(75) Inventors: Tadahiro Minamidate; Yoshiyuki Kajiura, both of Kanagawa (JP)

(73) Assignee: Calsonic Kansei Corporation, Tokyo (JP)

( * ) Notice: Subject to any disclaimer, the term of this patent is extended or adjusted under 35 U.S.C. 154(b) by 0 days.

(21) Appl. No.: 09/899,947

(22) Filed: Jul. 9, 2001

Related U.S. Application Data

(62) Division of application No. 09/314,167, filed on May 19, 1999, now Pat. No. 6,282,939.

(51) Int. Cl.[7] ..... B21D 15/06
(52) U.S. Cl. ..... 72/302
(58) Field of Search ..... 72/302, 299, 295

(56) References Cited

U.S. PATENT DOCUMENTS

| | | | | | |
|---|---|---|---|---|---|
| 743,193 | A | * | 11/1903 | Rainforth | 72/370.19 |
| 2,164,343 | A | * | 7/1939 | Nighthart | 72/302 |
| 2,315,971 | A | * | 4/1943 | Lake | 72/302 |
| 2,371,991 | A | * | 3/1945 | Harding | |
| 2,485,969 | A | * | 10/1949 | Johnson | 72/68 |
| 3,019,820 | A | | 2/1962 | Yowell et al. | 138/121 |
| 3,326,091 | A | * | 6/1967 | Allen | 29/454 |
| 3,699,624 | A | * | 10/1972 | De Gain | 138/173 |
| 4,317,353 | A | * | 3/1982 | Geppelt | 72/299 |
| 4,393,674 | A | | 7/1983 | Rasmussen | 72/61 |
| 4,726,212 | A | * | 2/1988 | Deroche | 72/302 |
| 4,821,551 | A | * | 4/1989 | Ogino | 72/302 |
| 5,461,767 | A | * | 10/1995 | Okubo | 72/369 |
| 5,522,247 | A | * | 6/1996 | Mitsubayashi | 72/302 |
| 5,848,546 | A | * | 12/1998 | Allison | 72/302 |

FOREIGN PATENT DOCUMENTS

| | | | | |
|---|---|---|---|---|
| DE | 473462 | * | 3/1929 | 72/302 |
| EP | 395042 | * | 10/2000 | |
| JP | 61-187916 | * | 11/1986 | |
| RU | 564049 | * | 8/1977 | |
| SU | 564049 | * | 7/1977 | 72/302 |

OTHER PUBLICATIONS

Koichi, "Liquid Pressure Forming Device", Patent Abstracts of Japan, vol. 009, No. 209, Aug. 27, 1986k JP 60–068117, Apr. 18, 1985, Abstract.*

Hiroaki, "Manufacture of Bellows", Patent Abstracts of Japan, vol. 006, No. 249, Dec. 8, 1982, JP 57–146426, Dec. 9, 1982, Abstract.*

* cited by examiner

*Primary Examiner*—Daniel C. Crane
(74) *Attorney, Agent, or Firm*—Foley & Lardner

(57) ABSTRACT

In order to produce a metal bellows of a length of "Ls" for use in a heated atmosphere, the following steps take place. First, a blank of the bellows is prepared, which is a metal pipe having a plurality of bulges formed therearound. The blank has a length of "L" that is longer than the length "Ls". Then, the blank is axially compressed by a length of "a", so that the compressed blank has a length of "L–a" that is shorter than the length "Ls". Then, the compressed blank is axially expanded so that the expanded blank has a length of "L–a+b" that is longer than the length "Ls". Then, the force that has been applied to the blank is removed, and then the treated blank is left in room temperature until the time when the treated blank becomes to have the length of "Ls" due to the spring-back phenomenon.

3 Claims, 4 Drawing Sheets

METHOD AND DEVICE FOR PRODUCING BELLOWS

This application is a divisional of Ser. No. 09/314,167 filed May 19, 1999, now U.S. Pat. No. 6,282,939.

BACKGROUND OF THE INVENTION

1. Field of the Invention

The present invention relates in general methods and devices for producing or reforming a bellows, and more particularly methods and devices for producing or reforming a metal bellows installed in a flexible tube that is disposed in an exhaust pipe line of an automotive internal combustion engine to absorb undesired vibration of the exhaust pipe line and compensate relative displacement between two portions of the exhaust pipe line.

2. Description of the Prior Art

In order to clarify the task of the present invention, one conventional flexible tube to which a bellows is practically applied will be briefly described with reference to FIGS. 5 and 6 of the accompanying drawings. The conventional flexible tube depicted by FIGS. 5 and 6 is described in detail in Japanese Utility Model First Provisional Publication 61-187916.

In FIG. 6, there is shown the flexible tube which is generally designated by numeral 100. As is seen from this drawing, the flexible tube 100 is a device arranged to connect upstream and downstream exhaust pipes "UP" and "DP" of an exhaust pipe line in such a manner as to absorb the vibration of the pipe line, and/or compensate a relative displacement between the two pipes "UP" and "DP".

The flexible tube 100 comprises a metal bellows 102 that has an upstream end tightly disposed on a downstream end of the upstream exhaust pipe "UP" and a downstream end tightly disposed on an upstream end of the downstream exhaust pipe "DP". A cover 104 of braided metal wire covers or encloses the bellows 102 having an upstream end tightly disposed on the upstream end of the bellows 102 and a downstream end tightly disposed on the downstream end of the bellows 102. For the tight mounting of the upstream and downstream ends of both the bellows 102 and the cover 104 onto the upstream and downstream exhaust pipes "UP" and "DP", respective metal collars 106 and 108 are tightly disposed on the upstream and downstream ends of the cover 104, as shown. The bellows 102 can absorb vibration transmitted thereto from an internal combustion engine (not shown) through the upstream exhaust pipe "UP". That is, upon receiving vibration, the bellows 102 is subjected to a certain resilient deformation due to the nature thereof, which absorbs the vibration and compensates a relative displacement between the upstream and downstream pipes "UP" and "DP".

The cover 104 functions to restrict an excessive elongation of the bellows 102 and to protect the bellows 102 from being hit by small stones or the like flying from the road. That is, by a certain length, the cover 104, which is constructed of braided metal wire, can axially expand following the elongation of the bellows 102. Thus, when the elongation of the bellows 102 reaches to the certain length, the cover 104 now functions to stop the further elongation of the bellows 102. That is, due to provision of the cover 104, the bellows 102 can be protected from making an excessive elongation. In other words, the bellows 102 can expand axially by a certain length within the cover 104.

For assembling the flexible tube 100, the metal bellows 102 is reformed before being put into the cover 104. That is, the metal bellows 102 is subjected to a so-called "single compression process" for achieving both a dimensional stability of the treated bellows 102 and an appropriate axial flexibility of the treated bellows 102. That is, as is seen from FIG. 5, in this compression process, a blank 102X of the bellows 102 is compressed once to the length "L−a" which is shorter than the normal length "Ls" of the bellows 102. This compression process is positively carried out for the reason originating from an inevitably occurring "spring-back phenomenon" of the compressed bellows 102Y. In fact, due to this spring-back phenomenon, after the compression, the over-compressed bellows 102Y gradually expands to have the normal length of "Ls". Furthermore, due to this compression, the pitch of bulges of the treated bellows 102 becomes small causing each bulge to have a generally ω-shaped cross section, which brings about an appropriate axial flexibility or resilient deformation of the bellows 102.

However, it has been revealed that the above-mentioned single compression of the bellows 102X leaves in the bellows 102 a stress (or residual stress) of a type that causes the bellows 102 to expand in an axial direction when heated.

Accordingly, when the flexible tube 100 having the above-mentioned bellows 102 installed therein is practically used, that is, used in an exhaust pipe line of the engine, the entire length "Ls" of the bellows 102 tends to increase due to releasement of the residual stress by the heat of the exhaust gas from the engine. The increase in the entire length "Ls" of the bellows 102 however means a reduction in the certain length by which the bellows 102 can expand axially within the cover 104. That is, a so-called "elongation flexibility" of the bellows 102 is reduced or lowered at the time when the flexible tube 100 is being practically used.

The expansion/contraction of the bellows 102 is carried out while being interrupted by the cover 104. The cover 104 has such a structure as to reduce its diameter when axially expanded. Thus, elongation of the bellows 102 caused by application of the exhaust gas heat thereto brings about elongation of the cover 104 and thus reduces the diameter of the same. Reduction in diameter of the cover 104 narrows an annual space defined between the bellows 102 and the cover 104, which causes an obstacle to the elongation flexibility of the bellows 102. This fact will be understood from the graph of FIG. 4.

The graph of FIG. 4 shows a relationship between the force "F" needed for elongation of a bellows and the elongation "E" of the bellows. In the graph, the solid line curve represents the elongation flexibility possessed by a normally dimensioned bellows 102A installed in the cover 104, which has the normal length "Ls" and the critical elongation "S". As is seen from this graphs in the normally dimensioned bellows 102A, within the region of the critical elongation "S", the elongation "E" of the bellows 102A increases substantially in proportional to the elongation force "F" applied to the bellows 102A. While, when the elongation "E" extends beyond the critical elongation "S", the elongation force "F" suddenly increases and thus the elongation flexibility of the bellows 102A is lowered. The broken line curve represents the elongation flexibility possessed by a bellows 102B somewhat expanded due to the exhaust gas heat applied thereto, which has the length "Ls1" greater than "Ls" and the critical elongation "S1" smaller than "S". As is seen from the graph, in this bellows 102B, due to the reduction in critical elongation, the sudden increase of the elongation force "F" appears at an initial stage of the elongation "E". This means that the elongation flexibility of the bellows 102B is poor as compared with that of the bellows 102A. The phantom line curve represents the elongation flexibility possessed by a bellows 102C somewhat shorter than the bellows 102A due to excessive compression applied thereto, which has the length "Ls2" smaller than "Ls" and the critical elongation "S2" greater than "S". Although this bellows 102C can provide a sufficient elongation under the practical use, the shorter initial length "LS2" of the bellows 102C brings about a difficulty with which the bellows 102C is installed in the cover 104. That is, in this case, the flexible tube 100 assembled fails to have a normally dimensioned structure.

According to tests executed by the inventors, the following facts have been further revealed. That is, when a bellows of the length of about 300 mm that has been subjected to a single compression process is left in a room temperature, the bellows is expanded or elongated by about 2 mm. While, when the bellows is practically used or heated by the exhaust gas from an engine, the bellows is expanded or elongated by about 6 to 8 mm. This means that even if the bellows is subjected to the single compression process, a certain stress (or residual stress) is left in the bellows, which causes the bellows to expand in an axial direction particularly when heated. The inventors have further revealed that the stress in the bellows can be sufficiently removed when the bellows is annealed at about 600° C. for about 2 minutes. However, in this case, due to adding of the annealing process, the production process becomes complicated and thus the cost of the flexible tube is increased.

SUMMARY OF THE INVENTION

It is therefore an object of the present invention to provide a method of producing a bellows which is free of the above-mentioned drawbacks.

It is another object of the present invention to provide a producing device with which the method of the present invention can be practically carried out.

According to a first aspect of the present invention, there is provided a method for producing a metal bellows of a length of "Ls" for use in a heated atmosphere. The method comprises the steps of (a) preparing a blank of the bellows, the blank being a metal pipe having a plurality of bulges formed therearound, the blank having a length "L" that is longer than the length "Ls"; (b) axially compressing the blank by a length of "a", so that the compressed blank has a length of "L−a" that is shorter than the length "Ls"; (c) axially expanding the compressed blank so that the expanded blank has a length of "L−a+b" that is longer than the length "Ls"; (d) removing the force that has been applied to the blank for expanding the same; and (e) leaving the treated blank in a room temperature until the time when the treated blank becomes to have the length of "Ls" due to the spring-back phenomenon.

According to a second aspect of the present invention, there is provided a device for reforming a bellows for use in a heated atmosphere. The bellows is a metal pipe having a plurality of bulges formed therearound. The device comprises a base member; a first clamp device fixedly mounted on the base member, the first clamp device having a first hydraulically actuated clamping means which clamps one tubular end of the bellows when actuated; a second clamp device movably mounted on the base member, the second clamp device having a second hydraulically actuated clamping means which clamps the other tubular end of the bellows when actuated; a hydraulic power source which hydraulically actuates the first and second hydraulically actuated clamping means when assuming ON condition; and an electric moving device which moves the second clamp device toward and away from the first clamp device when electrically energized.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

In the following, the method of the present invention, through which a bellows 2 is produced or reformed, will be described in detail with reference to FIGS. 1 to 3 of the accompanying drawings. The shape of the bellows 2 produced by the method is substantially the same as that of the bellows 102 employed in the conventional flexible tube 100 of FIG. 6. For ease of description, in the following description, only the term "produce" and its corresponding terms will be used for explaining the method of the invention.

Figure 1:
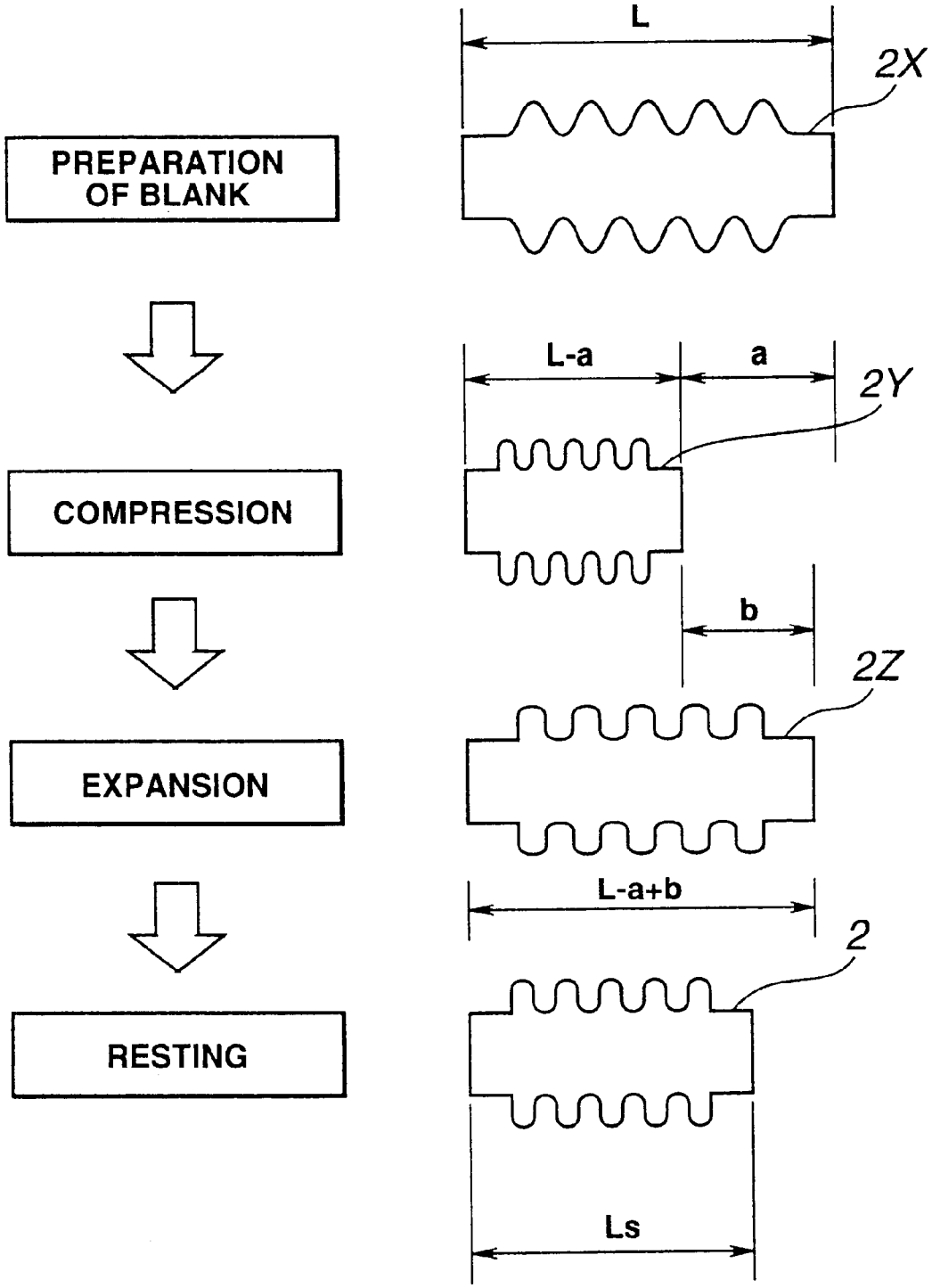
FIG. 1 shows bellows producing or reforming steps employed in a method according to the present invention.

For producing the bellows 2, the following production steps take plate, which are depicted in FIG. 1.

That is, first, a blank 2X of the bellows 2 is prepared. The blank 2X is a double-layered stainless steel pipe having a plurality of bulges formed therearound. For the production of the blank 2X, a known hydraulic bulging process is used. That is, to carry out this process, a double-layered stainless straight pipe is set in a split mould whose inner surface is formed with a plurality of annular grooves, and then a certain hydraulic pressure is led into the interior of the pipe to expand the pipe radially outward. With this, the pipe is forced to have therearound a plurality of bulges due to abutment against the grooved inner surface of the mould, that is, the blank 2X having the length "L" is produced.

Then, the blank 2X is axially compressed by the length "a" against a counterforce produced by the blank 2X when compressed, so that the compressed blank 2Y has the length "La" which is shorter than the normal length "Ls" of the bellows 2.

Then, the compressed blank 2Y is axially expanded by the length "b" against a counterforce produced by the blank 2Y when expanded, so that the expanded blank 2Z has the length "L−a+b" which is longer than "Ls" but shorter than "L".

Then, the force for expanding the blank 2Z is removed. Upon this, the expanded blank 2Z is forced to contract to have a certain length which is somewhat longer than the normal length "Ls". Then, the blank 2Z is left in a room temperature for several minutes. With this, because of the spring-back phenomenon of the blank 2Z, the blank 2Z becomes to have the normal length "Ls". That is, the bellows 2 is produced.

As will be described in detail hereinafter, the bellows 2 thus produced in the above-mentioned manner exhibits excellent performance.

Figure 2:
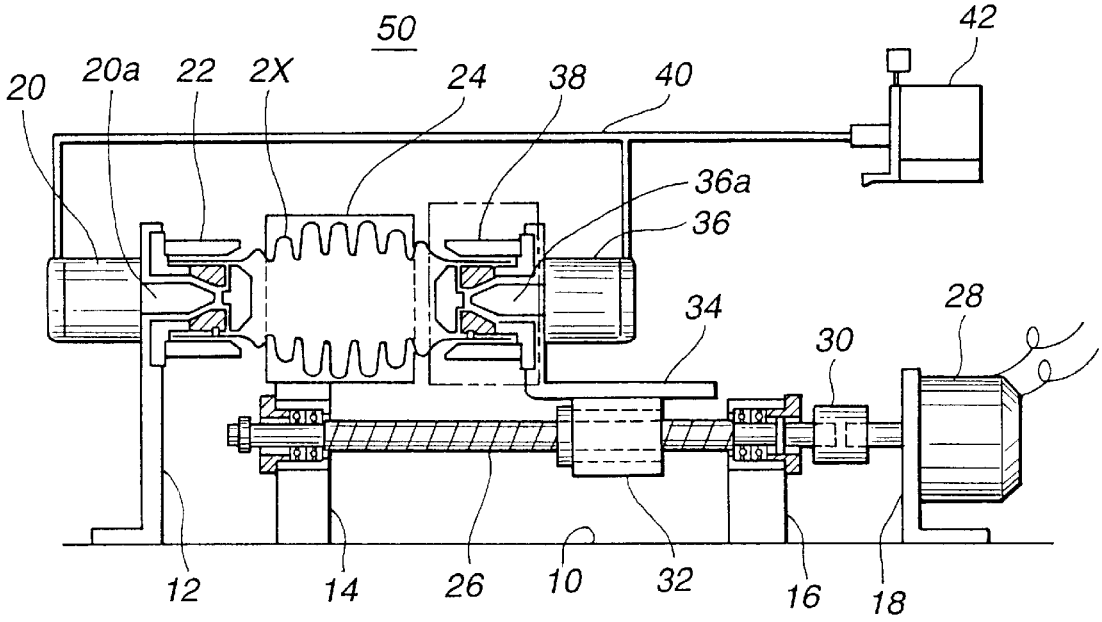
FIG. 2 is a partially sectioned front view of a bellows producing or reforming device which practically execute the method of the present invention.

Referring to FIG. 2, there is shown a bellows producing device 50 through which the above-mentioned bellows production steps are practically carried out.

The bellows producing device 50 comprises a base member 10. On the base member 10, there are mounted first, second, third and fourth stands 12, 14, 16 and 18. The first stand 12 holds thereon both a first hydraulic actuator 20 and a first clamp device 22. The actuator 20 has a plunger 20*a* that can project toward a center of the first clamp device 22. The detail of the clamp device 22 will become apparent hereinafter. The second stand 14 holds thereon a guide 24 for the blank 2X. The second stand 14 rotatably carries a front end portion of a threaded shaft 26. The third stand 16 rotatably carries a rear end portion of the threaded shaft 26. The fourth stand 18 holds a servo-motor 28 that has an output shaft connected through a coupling 30 to the rear end of the threaded shaft 26. Thus, upon energization of the servo-motor 28, the threaded shaft 26 is rotated about its axis. Disposed on the threaded shaft 26 is a slider 32 that has a threaded bore through which the threaded shaft 26 passes while establishing a meshed engagement therebetween. Although not shown in the drawing, a slider guide is mounted on the base member 10, which guides an axial movement of the slider 32 while suppressing rotation of the slider 32 about the axis of the threaded shaft 26. Thus, when, due to energization of the servomotor 28, the threaded shaft 26 is rotated about its axis, the slider 32 runs in fore-and-aft directions on the threaded shaft 26. The slider 32 carries thereon a fifth stand 34. The fifth stand 34 holds thereon both a second hydraulic actuator 36 and a second clamp device 38 which are thus moved together with the slider 32. The actuator 36 has an output plunger 36*a* that can project toward a center of the second clamp device 38. As shown, the first and second camp devices 22 and 38 are arranged to face each other. The first and second hydraulic actuators 20 and 36 are connected through a flexible fluid pipe 40 to a pressurized fluid source 42. Although not shown in the drawing, the fluid source 42 is equipped with an ON/OFF valve by feeding of the fluid pressure from the fluid source 42 to the first and second hydraulic actuators 20 and 36 is controlled.

The detail of the second clamp device 38 will be described with reference to FIG. 3. Since the first clamp device 22 is substantially the same as the second clamp device 38, the description of the first clamp device 22 will be omitted.

Figure 3:
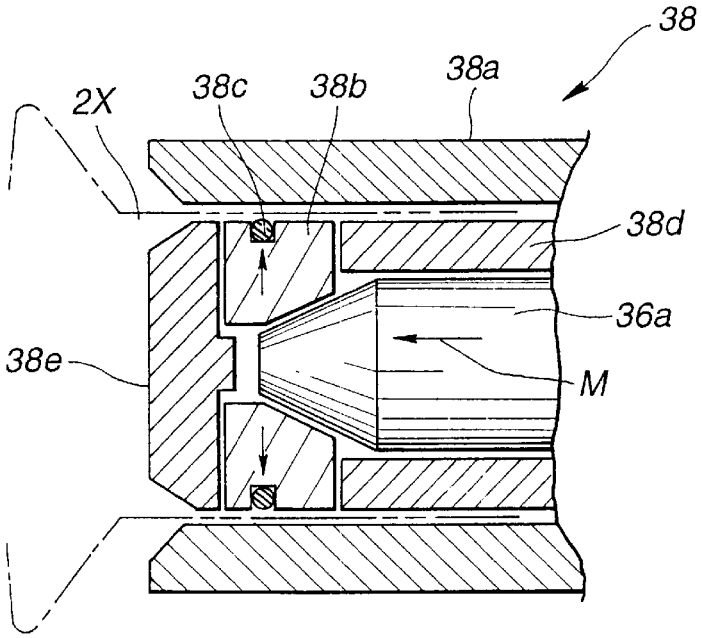
FIG. 3 is an enlarged view of the part indicated by reference "A" in FIG. 2.
Figure 4:
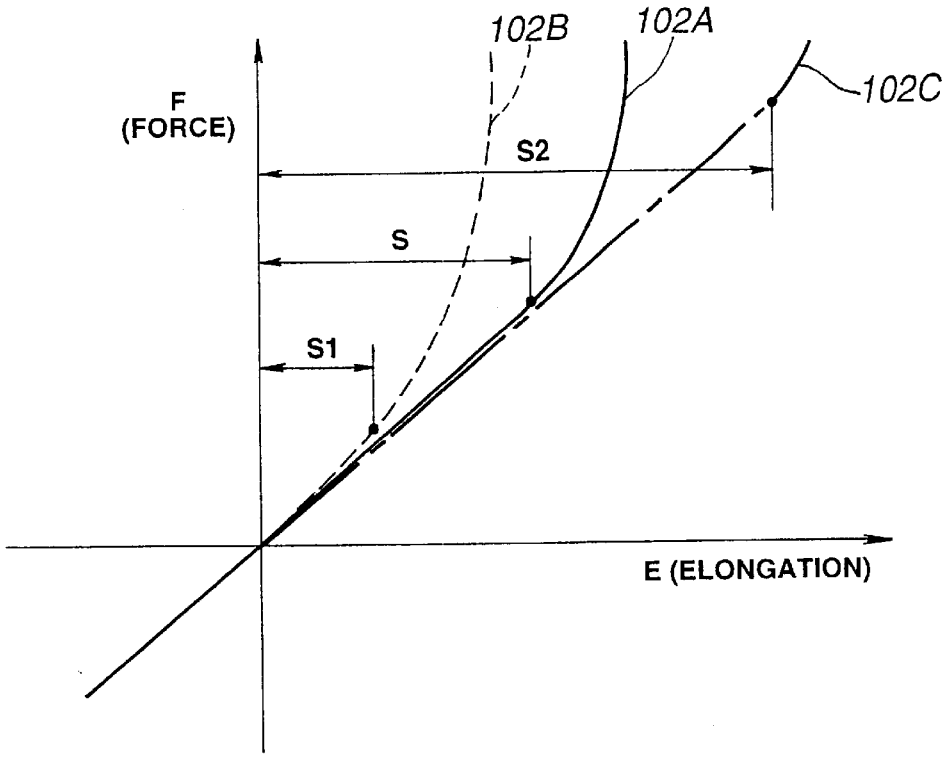
FIG. 4 is a graph showing the characteristics of three bellows in terms of a relationship between the force needed for elongation of the bellows and the elongation of the bellows.

As is seen from FIG. 3, the second clamp device 38 comprises a tubular housing 38*a* in which the output plunger 36*a* of the second hydraulic actuator 36 is axially movably received. As shown, the plunger 36*a* has a tapered leading end. Within the tubular housing 38*a*, there are movably disposed a plurality (viz., three in the illustrated embodiment) of clamp pieces 38*b* that are arranged to surround an axis of the tubular housing 38*a*. Each clamp piece 38*b* is formed with a tapered inner surface which can mate the tapered end of the plunger 36*a*. The clamp pieces 38*b* are formed with an annular groove in which an O-ring 38*c* is received. The clamp pieces 38*b* are supported by supporting members 38*d* which surround a major portion of the plunger 36*a*. A circular cap 38*e* is put on the clamp pieces 38*b*. As shown, in use, a right tubular end of the blank 2X is received in an annular clearance defined between the tubular housing 38*a* and a cylindrical unit consisting of the plunger 36*a*, the clamp pieces 38*b*, the supporting members 38*d* and the circular cap 38*e*. When, due to energization of the second hydraulic actuator 36, the plunger 36*a* is shifted leftward (viz., in the direction of the arrow "M") by a certain degree, the tapered end of the plunger 36*a* urge the clamp pieces 38*b* to move radially outwardly causing the O-ring to press the right tubular end of the blank 2X against the tubular housing 38*a*. With this, the right tubular end of the blank 2X is tightly clamped by the second clamp device 38. It is to be noted that a left tubular end of the blank 2X is clamped by the first clamp device 22 in substantially the same manner as that effected in the above-mentioned second clamp device 38.

In the following, operation of the bellows producing device 50 will be described with reference to FIGS. 2 and 3.

First, by energizing the servo-motor 28 to rotate in one direction, the second clamp device 38 is moved away from the first clamp device 22 to a certain position. Then, the blank 2X of the bellows 2 is set in the guide 24 having its left tubular end led into the annular clearance of the first clamp device 22. Then, by energizing the servo-motor 28 to rotate in the other direction, the second clamp device 38 is moved toward the first clamp device 22 while receiving the right tubular end of the blank 2X in the annular clearance thereof. When the left and right tubular ends of the blank 2X are properly received in the respective annular clearances of the first and second clamp devices 22 and 38, the servo-motor 28 is deenergized. Then, by energizing the ON/OFF valve of the fluid source 42, pressurized fluid of the fluid source 42 is led to both the first and second hydraulic actuators 20 and 36. With this, the respective plungers 20*a* and 36*a* are moved to actuate the clamp pieces 38*b*, and thus for the above-mentioned reasons, the left and right tubular ends of the blank 2X are tightly clamped by the first and second clamp devices 22 and 38. It is to be noted that under this condition, the blank 2X has the axial length of "L" (see FIG. 1).

Then, by energizing the servo-motor 28, the second clamp device 38 is moved toward the fixed first clamp device 22 to compress the blank 2X. When the blank 2X is compressed to such a degree as to have the length of "L−a" (see FIG. 1), the energization of the servo-motor 28 is reversed to expand the compressed blank 2Y. When, due to the expansion, the blank 2Y becomes to have the length of "L−a+b", the servo-motor 28 is deenergized. Then, the ON/OFF valve is deenerigzed to release the right and left tubular ends of the expanded blank 2Z from the first and second clamp devices 22 and 38. Then, by energizing the servo-motor 28, the second clamp device 38 is moved away from the first clamp device 22 to dismantle the blank 2Z from the first and second clamp devices 22 and 38.

Figure 6:
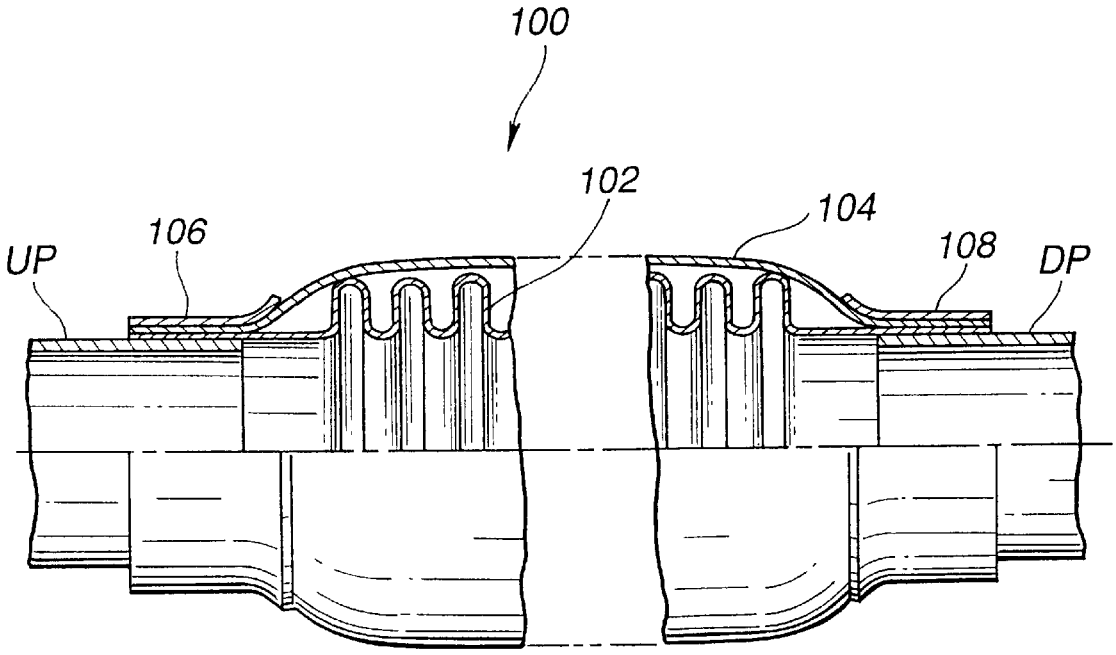
FIG.6 (PRIOR ART)
FIG. 6 is a partially sectioned front view of a flexible tube to which the bellows produced or reformed by the conventional method is applied.

The bellows 2 thus produced or reformed in the above-mentioned manner is used for assembling the flexible tube such as that shown in FIG. 6.

Figure 5:
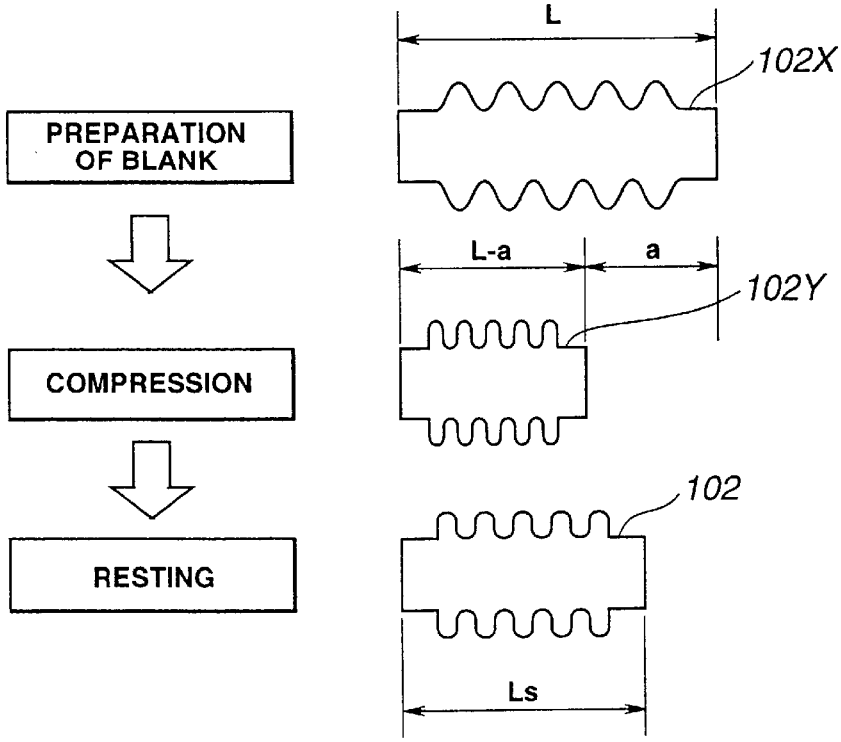
FIG.5 (PRIOR ART)
FIG. 5 shows bellows producing or reforming steps employed in a conventional method.

It has been revealed that the bellows 2 produced in the above-mentioned manner has an excellent dimensional stability as compared with the bellows 102 (see FIG. 5) produced in the conventional manner. That is, even when the bellows 2 is practically used in the exhaust pipe line of the internal combustion engine as a part of the flexible tube, the entire length "Ls" is kept substantially unchanged irrespective of the temperature change of the exhaust pipe line. In fact, a very small shrinkage takes place in the bellows 2. This may be caused from the residue of a stress of a type that causes the bellows 2 to contract in an axial direction when heated. It is however to be noted that the reduction in length of the bellows 2 means an increase in the certain length by which the bellows 2 can expand axially within the cover of the flexible tube. That is, the elongation flexibility of the bellows 2 is increased at the time when the flexible tube is practically used.

The entire contents of Japanese Patent Application P9-327735 (filed Nov. 28, 1997) are incorporated herein by reference.

Although the invention has been described above by reference to a certain embodiment of the invention, the invention is not limited to the embodiment described above. Modifications and variations of the embodiment described above will occur to those skilled in the art, in light of the above teachings.

What is claimed is:

1. A device for reforming a bellows for use in a heated atmosphere, said bellows being a metal pipe having a plurality of bulges formed therearound, said device comprising:

a base member;

a first clamp device fixedly mounted on said base member, said first clamp device having a first hydraulically actuated clamping means which clamps one tubular end of said bellows when actuated;

a second clamp device movably mounted on said base member, said second clamp device having a second hydraulically actuated clamping means which clamps the other tubular end of said bellows when actuated;

a hydraulic power source which hydraulically actuates said first and second hydraulically actuated clamping means when assuming ON condition; and an electric moving device which moves said second clamp device toward and away form said first clamp device when electrically energized, wherein each of said first and second hydraulically actuated clamping means comprises:

a hydraulic actuator having an output plunger, said output plunger having a tapered leading end;

a tubular housing in which said output plunger is axially movably received;

a plurality of clamp pieces installed in said tubular housing in a manner to surround the tapered leading end of said output plunger, each clamp piece having a tapered inner surface which can mate the tapered end of said plunger;

an O-ring received in an annular groove which is formed in the clamp pieces;

supporting members installed in said tubular housing in a manner to surround a major portion of said output plunger, each supporting member supporting one end of the corresponding clamp piece; and a circular cap installed in said tubular housing and put on the clamp pieces.

2. A device as claimed in claim 1, in which said electric moving device comprises:

a slider on which said second clamp device is mounted to move therewith, said sliding having a threaded bore formed therethrough;

a threaded shaft passing through said threaded bore of said slider while providing a meshed engagement therebetween;

a supporting device for rotatably supporting said threaded shaft on said base member; and a servo-motor for rotating said threaded shaft when electrically energized.

3. A device as claimed in claim 2, in which said supporting device holds a guide by which said bellows is held and guided.

* * * * *